United States Patent [19]
Wedel
[11] 4,318,253
[45] Mar. 9, 1982

[54] METHOD AND APPARATUS FOR PROTECTING PLASTIC COVERS FROM DETERIORATION

[76] Inventor: Janet Wedel, 2717 Wyman Dr., SE., Auburn, Wash. 98002

[21] Appl. No.: 135,163

[22] Filed: Mar. 28, 1980

[51] Int. Cl.[3] ..... E04B 1/12
[52] U.S. Cl. ..... 52/63; 52/309.1; 52/741
[58] Field of Search ..... 52/222, 63, 309.1, 2, 52/86, 273, 741; 4/498; 47/17

[56] References Cited
U.S. PATENT DOCUMENTS
3,004,543 10/1961 Pinet ..... 47/17 X
4,136,408 1/1979 Dahlbeck et al. ..... 47/17 X

*Primary Examiner*—Price C. Faw, Jr.
*Assistant Examiner*—Carl D. Friedman
*Attorney, Agent, or Firm*—Seed, Berry, Vernon & Baynham

[57] ABSTRACT
Accelerated deterioration of a flexible polyvinyl chloride sheet is retarded by placing a spacer layer between the flexible sheet and a solid polyvinyl chloride support member for the flexible sheet. The spacer isolates the flexible sheet material from the solid material and also dissipates heat when the combination is exposed to sunlight.

6 Claims, 3 Drawing Figures

METHOD AND APPARATUS FOR PROTECTING PLASTIC COVERS FROM DETERIORATION

BACKGROUND OF THE INVENTION

1. Field of the Invention

This invention relates to apparatus and methods for spacing polyvinyl chloride materials or other synthetic plastic materials to prevent accelerated deterioration due to exposure to solar radiant energy and the like.

2. Prior Art Relating to the Disclosure

Polyvinyl chloride (PVC) materials are extemely versatile in the sense that, by varying the amount of plasticizers added to the material, a wide range of characteristics can be obtained. For example, a polyvinyl chloride material with no plasticizers is used for rigid pipes and the like. Addition of appropriate plasticizers to a polyvinyl chloride material produces a material which can be formed into thin, flexible sheets. Both the rigid pipe and the flexible sheets are used, as described in U.S. Pat. No. 4,136,408, to provide a lightweight removable cover for a pool, greenhouse, or the like. Tubular rigid polyvinyl chloride pipes are joined together to provide a rigid support frame for the flexible polyvinyl chloride cover sheet which overlies the frame and covers the enclosure thereby defined. Heretofore, the flexible sheet polyvinyl chloride material directly contacted the rigid polyvinyl tubular support members and was clamped at its lower ends to the vertical side walls of the structure. This structure and method of assembly have proved entirely satisfactory for enclosures of this type. However, after these structures are exposed to strong sunlight for a period of time, the clear, flexible polyvinyl chloride sheet material overlying and directly contacting the rigid polyvinyl chloride support structure discolors and deteriorates at an accelerated rate in comparison to areas of the flexible sheet which are not in contact with the support members. The sheet material overlying the support members gradually becomes brittle and cracks. The flexible polyvinyl chloride sheet material also fuses to the rigid polyvinyl chloride pipe due to heat buildup between the sheet and the supporting pipe. This accelerated deterioration of the flexible polyvinyl chloride material in contact with the polyvinyl chloride material due to exposure to sunlight is a serious problem and detracts from the appearance and utility of enclosures constructed from the otherwise very satisfactory materials.

SUMMARY OF THE INVENTION

It is therefore an object of the invention to provide apparatus and a method for preventing accelerated deterioration of flexible polyvinyl chloride sheet material overlying solid polyvinyl chloride support structures when exposed to sunlight.

It is another object of the invention to reduce the temperature of a flexible synthetic plastic cover sheet overlying a rigid synthetic plastic support structure when exposed to sunlight.

It is another object of the invention to provide apparatus and method for eliminating fusing of flexible polyvinyl chloride sheet material to the underlying solid polyvinyl chloride support structures and reducing accelerated migration of plasticizer material and ultraviolet inhibitors from the flexible polyvinyl chloride sheet when exposed to sunlight.

These and other objects of the invention are basically achieved by the apparatus and a method which retard accelerated deterioration of those areas of a flexible polyvinvyl chloride sheet material which overlie rigid polyvinyl chloride support members when the combination is exposed to sunlight. The invention also provides for dissipation of heat from between a flexible synthetic plastic cover and a rigid synthetic plastic support member. The invention isolates and prevents contact between the flexible cover and the rigid support member. A particular embodiment of the invention utilizes a mesh structure which is positioned between facing portions of a flexible polyvinyl chloride sheet and a rigid polyvinyl chloride support member. The mesh serves as a spacer or isolation means to prevent the flexible polyvinyl chloride sheet from contacting the rigid polyvinyl chloride support member and having the plasticizers and ultraviolet inhibitors migrate from the flexible material to the rigid material. The meshed spacer also prevents the junction of the sheet and the support from reaching extreme temperatures. The method provided in accordance with this invention includes isolating and spacing of the sheet from the support members by the application of spacer strips to the support members so that the flexible sheet is spaced apart from the support members, thereby preventing accelerated deterioration of the flexible sheet material due to exposure to sunlight and heat.

The exact phenomenon which causes deterioration is not understood. It appears to be either heat and ultraviolet rays from sunlight and/or surface migration of the plasticizers and inhibitors due to contact between the vinyl cover and the PVC pipe. It may be a combination of these factors with the most severe factor not being known. The preferred embodiments of the invention solve the problem by both dissipating heat as well as isolating the vinyl cover from contact with the pipe, but it is understood that merely isolating or merely dissipating the heat alone may have advantageous results.

DETAILED DESCRIPTION OF THE PREFERRED EMBODIMENTS

Figure 1:
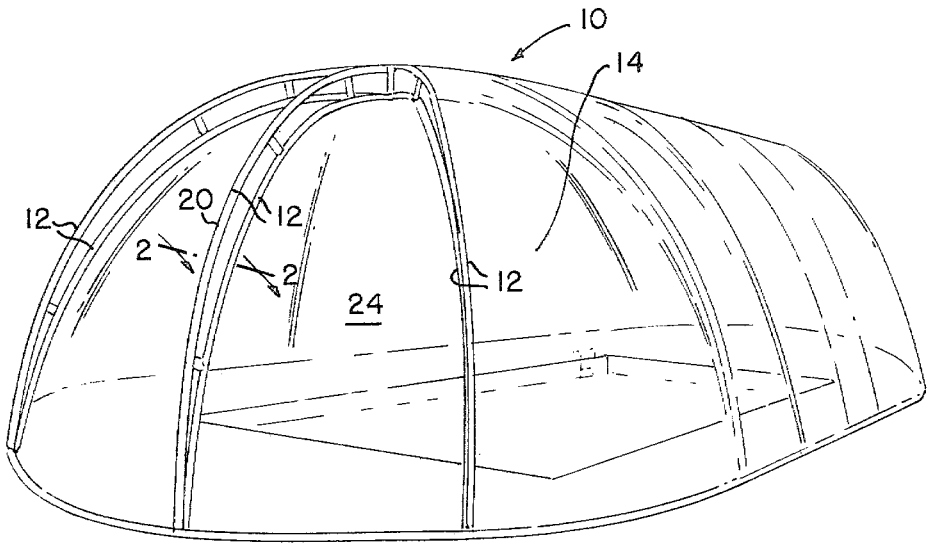
FIG. 1 is an elevation view of a typical enclosure utilizing a flexible polyvinyl chloride sheet supported by a structure using rigid polyvinyl chloride support members.

Referring to FIG. 1, a typical enclosure 10 is shown for covering a pool or defining a building, such as a greenhouse or the like. A typical enclosure structure is disclosed in U.S. Pat. No. 4,136,408, hereby incorporated by reference. The framework of the enclosure is formed from a plurality of interfitting, rigid members 12, formed from a material such as polyvinyl chloride pipe and having an inside diameter of one and one-half inches, which diameter increases for larger structures. The pipe members are joined together to support a flexible plastic sheet 14 which overlies the supporting framework and is held in place near the base of the framework by conventional means. Enclosures of the type described above are intended primarily for use outdoors and, consequently, are often exposed to strong ultraviolet radiation, which, in spite of the addition of ultraviolet inhibitors, causes accelerated deterioration of the cover if the cover directly contacts the framework.

The rigid polyvinyl chloride support members 12 contain no plasticizer materials and the flexible polyvinyl chloride sheet 14 contains plasticizers which give the cover 14 its flexible characteristic. Prolonged exposure to ultraviolet radiation and heat causes the plasticizer materials and ultraviolet inhibitors in the cover sheet 14 to migrate from the material. The ultraviolet inhibitors are intended to limit the rate at which the plasticizers migrate. However, experience indicates that when the flexible polyvinyl chloride material directly contacts the rigid polyvinyl chloride support members, the rate of migration of the plasticizers and inhibitors increases and clear sheet material becomes yellow due to loss of inhibitors and prematurely brittle due to loss of plasticizers so that it cracks when flexed. It has also been experienced that exposure of an enclosure of the type exemplified in FIG. 1 to sunlight may cause excessive heat to be built up between a cover sheet which lies directly on the support members to the extent that the sheet material may be softened sufficiently, in the case of polyvinyl chloride materials, to eventually cause the sheet to be bonded directly to the rigid support members. This invention provides apparatus for dissipating heat from between the flexible vinyl cover and the rigid polyvinyl chloride support member and also for isolating the flexible polyvinyl chloride cover sheet from the rigid polyvinyl chloride support member to prevent accelerated migration of the plasticizers and the ultraviolet inhibitors from the flexible vinyl sheet when irradiated with ultraviolet radiation.

Figure 2:
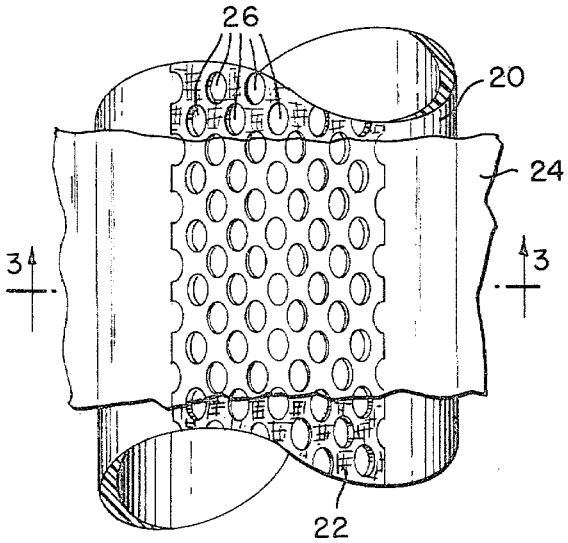
FIG. 2 is a detailed view, taken along section line 2—2 of FIG. 1, showing a portion of an enclosure structure using a spacer according to the invention.
Figure 3:
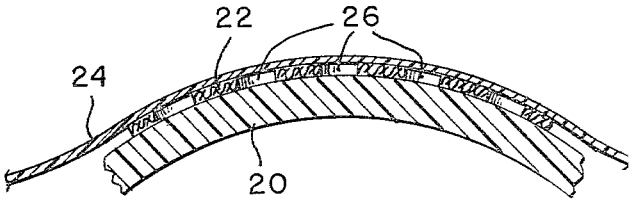
FIG. 3 is a detailed sectional view, taken along section line 3—3 of FIG. 2, showing a portion of a rigid support member overlaid with a flexible sheet spaced by a mesh structure.

Referring to FIG. 2, a preferred embodiment of my structure for preventing deterioration is shown. A rigid polyvinyl chloride support member 20 has long strips 22 of webbed material adhesively bonded along the surfaces underlying a portion of a flexible polyvinyl chloride cover sheet 24. FIG. 3 shows a cross-section of the preferred spacer structure. The meshed structure of the spacer strip 22 permits heat to be readily dissipated from between the flexible cover and the rigid support member. Both the flexible cover and the rigid support member may be formed from various suitable conventional synthetic plastics materials with the spacer providing for heat dissipation. In the case of polyvinyl chloride materials, the strip 22 also prevents accelerated migration of the plasticizer and ultraviolet inhibitors from the flexible polyvinyl chloride cover 24 due to ultraviolet radiation and heat when the combination is exposed to intense, direct sunlight.

In the preferred embodiment, the strips 22 are made of nylon filaments having a 750 denier and having large openings 26 woven throughout. The strips 22 are adhesively bonded to the outside segments of the rigid polyvinyl chloride support members 20 using any suitable adhesive such as a 3 M Company product designated "76 Adhesive," which has produced satisfactory results. Strips of a loosely woven polyester material have also produced satisfactory results. When the enclosures using spacer strips have been exposed to strong sunlight for prolonged periods, no deterioration has been observed.

The method for preventing accelerated deterioration of a flexible polyvinyl chloride sheet which overlies a support frame made of rigid polyvinyl chloride members includes isolating the sheet from direct contact with the rigid support members and also includes spacing the sheet from the rigid support members.

The method for practicing the invention also includes applying strips 22 of materials, such as the nylon and polyester materials previously discussed, to the outside segments of the rigid polyvinyl chloride support members 20. The support structure is then covered with a flexible polyvinyl chloride sheet 24 so that the sheet 24 is spaced apart from the support members 20 by the strips 22 to prevent accelerated deterioration of the flexible polyvinyl chloride sheet material due to exposure to strong, direct sunlight.

While particular embodiments of apparatus and a method for practicing the invention have been shown and described, it should be understood that the invention is not limitd thereto since many modifications may be made. It is therefore contemplated to cover by the present application any and all such modifications that fall within the true spirit and scope of the basic underlying principles disclosed and claimed herein.

I claim:

1. Apparatus for retarding deterioration of a flexible synthetic plastic cover, comprising:

at least one rigid synthetic plastic support member for said flexible synthetics plastic cover;

said flexible cover overlying a portion of the rigid synthetic plastic support member;

means for dissipating heat from between the flexible synthetic plastic cover and the rigid synthetic plastic support member to prevent accelerated deterioration of the flexible synthetic plastic cover when exposed to sunlight, including spacer means for insulating the cover from the support member; and including a meshed member adhesively bonded to the support member.

2. Apparatus of claim 1, wherein the meshed member is nylon.

3. Apparatus for retarding the deterioration of a flexible polyvinyl chloride sheet having plasticizer materials contained therein and covering an enclosure, such as a swimming pool, greenhouse, or the like, comprising:

a rigid polyvinyl chloride member for supporting the flexible vinyl sheet;

a strip of material placed on a portion of the surface of the solid polyvinyl chloride member and spacing the flexible polyvinyl chloride sheet from the solid polyvinyl chloride member to prevent accelerated deterioration of the flexible polyvinyl chloride sheet when exposed to sunlight, wherein the strip is formed with a nylon mesh material and is adhesively bonded to the solid polyvinyl chloride member.

4. The apparatus of claim 3, wherein the strip is formed with a woven polyester material.

5. A method for retarding accelerated deterioration of a flexible polyvinyl chloride sheet which in combination with a plurality of rigid polyvinyl chloride support members provides an enclosure for a swimming pool, greenhouse or the like, comprising isolating the flexible polyvinyl chloride sheet from direct contact with the rigid polyvinyl chloride support members to prevent accelerated deterioration of the sheet due to exposure to sunlight;

spacing the sheet from the support members with at least one spacer member, and providing the spacer in a strip configuration and adhesively bonding the strip to at least one support member.

6. The method of claim 5, including forming the strip with a meshed structure.

* * * * *